US008604723B2

(12) United States Patent
Chen et al.

(10) Patent No.: US 8,604,723 B2
(45) Date of Patent: Dec. 10, 2013

(54) INTERLACED MULTI-ENERGY RADIATION SOURCES

(75) Inventors: Gongyin Chen, Henderson, NV (US); John Turner, Las Vegas, NV (US); Douglas W. Eaton, Las Vegas, NV (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 13/476,477

(22) Filed: May 21, 2012

(65) Prior Publication Data

US 2012/0230471 A1 Sep. 13, 2012

Related U.S. Application Data

(63) Continuation of application No. 12/228,350, filed on Aug. 12, 2008, now Pat. No. 8,183,801.

(51) Int. Cl.
*H01J 23/00* (2006.01)

(52) U.S. Cl.
USPC ..... 315/505; 315/500

(58) Field of Classification Search
USPC ..... 315/505, 500, 5.41, 5.43, 39.51, 39.53; 250/503.1
See application file for complete search history.

(56) References Cited

U.S. PATENT DOCUMENTS

| | | | |
|---|---|---|---|
| 2,817,821 | A | 12/1957 | Haagensen |
| 3,714,592 | A | 1/1973 | Jory |
| 3,806,836 | A | 4/1974 | Alsmeyer |
| 3,820,035 | A | 6/1974 | Meddaugh |
| 3,965,434 | A | 6/1976 | Helgesson |
| 4,988,919 | A | 1/1991 | Tanabe et al. |
| 5,044,006 | A | 8/1991 | Cyrulnik |

(Continued)

FOREIGN PATENT DOCUMENTS

| | | |
|---|---|---|
| CN | 1599537 | 3/2005 |
| CN | 101076218 | 11/2007 |

(Continued)

OTHER PUBLICATIONS

International Search Report and Written Opinion dated Feb. 15, 2011 issued in the corresponding International Patent Application No. PCT/US2009/004609. (8 pages).

(Continued)

*Primary Examiner* — Jack Berman
*Assistant Examiner* — Johnnie L Smith
(74) *Attorney, Agent, or Firm* — Brandon N. Sklar; Cozen O'Connor

(57) ABSTRACT

Multi-energy radiation sources comprising charged particle accelerators driven by power generators providing different RF powers to the accelerator, capable of interlaced operation, are disclosed. Automatic frequency control techniques are provided to match the frequency of RF power provided to the accelerator with the accelerator resonance frequency. In one example where the power generator is a mechanically tunable magnetron, an automatic frequency controller is provided to match the frequency of RF power pulses at one power to the accelerator resonance frequency when those RF power pulses are provided, and the magnetron is operated such that frequency shift in the magnetron at the other power at least partially matches the resonance frequency shift in the accelerator when those RF power pulses are provided. In other examples, when the power generator is a klystron or electrically tunable magnetron, separate automatic frequency controllers are provided for each RF power pulse. Methods and systems are disclosed.

25 Claims, 7 Drawing Sheets

(56) References Cited

U.S. PATENT DOCUMENTS

| | | | | |
|---|---|---|---|---|
| 5,471,516 | A | 11/1995 | Nunan | |
| 5,524,133 | A | 6/1996 | Neale et al. | |
| 5,608,403 | A | 3/1997 | Miller | |
| 5,661,377 | A | 8/1997 | Mishin et al. | |
| 5,661,774 | A | 8/1997 | Gordon et al. | |
| 5,841,237 | A * | 11/1998 | Alton | 315/111.81 |
| 5,933,335 | A | 8/1999 | Hitchcock et al. | |
| 6,038,284 | A | 3/2000 | Hernandez-Guerra et al. | |
| 6,069,936 | A | 5/2000 | Bjorkholm | |
| 6,151,381 | A | 11/2000 | Grodzins et al. | |
| 6,301,326 | B2 | 10/2001 | Bjorkholm | |
| 6,327,339 | B1 | 12/2001 | Chung et al. | |
| 6,366,021 | B1 | 4/2002 | Meddaugh et al. | |
| 6,407,505 | B1 | 6/2002 | Bertsche | |
| 6,483,163 | B2 | 11/2002 | Isogai et al. | |
| 6,493,424 | B2 | 12/2002 | Whitham | |
| 6,824,653 | B2 | 11/2004 | Oshmyansky et al. | |
| 6,844,689 | B1 | 1/2005 | Brown et al. | |
| 6,856,105 | B2 | 2/2005 | Yao et al. | |
| 7,110,500 | B2 | 9/2006 | Leek | |
| 7,112,924 | B2 | 9/2006 | Hanna | |
| 7,130,371 | B2 | 10/2006 | Elyan et al. | |
| 7,140,771 | B2 | 11/2006 | Leek | |
| 7,162,005 | B2 | 1/2007 | Bjorkholm | |
| 7,208,889 | B2 | 4/2007 | Zavadtsev et al. | |
| 7,257,188 | B2 | 8/2007 | Bjorkholm | |
| 7,339,320 | B1 | 3/2008 | Meddaugh et al. | |
| 7,391,849 | B2 | 6/2008 | Smith | |
| 7,400,094 | B2 | 7/2008 | Meddaugh | |
| 7,432,672 | B2 | 10/2008 | Meddaugh et al. | |
| 7,619,363 | B2 | 11/2009 | Whittum et al. | |
| 7,646,851 | B2 | 1/2010 | Liu et al. | |
| 2002/0094059 | A1 | 7/2002 | Grodzins | |
| 2002/0186577 | A1 * | 12/2002 | Kirbie | 363/131 |
| 2005/0117683 | A1 | 6/2005 | Mishin et al. | |
| 2007/0274445 | A1 | 11/2007 | Zavadtsev et al. | |
| 2007/0296530 | A1 | 12/2007 | Heisen et al. | |
| 2012/0262333 | A1 * | 10/2012 | Trummer | 342/146 |
| 2012/0294424 | A1 * | 11/2012 | Chin et al. | 378/65 |
| 2012/0326636 | A1 * | 12/2012 | Eaton et al. | 315/501 |

FOREIGN PATENT DOCUMENTS

| | | |
|---|---|---|
| EP | 0 673 187 | 9/1995 |
| EP | 0 817 546 | 1/1998 |
| GB | 2 335 487 | 9/1999 |
| GB | 2 438 278 | 11/2007 |
| JP | 2008-218053 | 9/2008 |
| SU | 762754 A1 | 2/1999 |
| WO | WO 00/43760 | 7/2000 |
| WO | WO 2004/030162 | 4/2004 |
| WO | WO 2010/019228 | 2/2010 |

OTHER PUBLICATIONS

"Magnetrons: Magnetron Theory of Operation" Communications & Power Industries. Available at http://www.cpii.com/docs/related/2/Mag_tech_art.pdf; Undated. (4 pages).

Communications & Power Industries Beverly Microwave Division "Frequency Agile Magnetrons" Communications & Power Industries. Available at http://www.cpii.com/docs/related/2/Mag_tech_art.pdf; Undated. (3 pages).

Communications & Power Industries Beverly Microwave Division "Beacon Magnetrons" Communications & Power Industries. Available at http://www.cpii.com/docs/related/2/Mag_tech_art.pdf; Undated. (3 pages).

Varian Medical Systems, Inc., "Linatron-M Modular High-Energy X-ray Source". Security & Inspection Products. Available at http://www.varian.com/media/security_and_inspection/products/pdf/cargobrief.pdf. Sep. 2007. (4 pages).

Varian Medical Systems, Inc., "Linatron-M Modular Interlaced High-Energy X-ray Source". Security & Inspection Products. Available at htto://www.varian.com/media/security_and_inspection/products/pdf/SIPspecMI4.pdf Jan. 2007. (4 pages).

Wang, et al., "Material Discrimination by High-Energy X-ray Dual-Energy Imaging", High Energy Physics and Nuclear Physics, vol. 31, No. 11, Nov. 2007, pp. 1076-1081.

Chuanxiang Tang, "Electron Linacs for Cargo Inspection and other Industrial Applications". Available at http://www-pub.iaea.org/MTCD/publications/PDF/P1433_CD/datasets/papers/sm_eb-28..pdf. Undated. (8 pages).

Chen Zhiqiang et al., "Cargo-X-ray Imaging Technology for Material Discrimination". Port Technology International. Available at http:www.nuctech.com/htmleditor/uploadfiled/20070309152255362.pdf. Nuctech Col, Ltd. 2007. (3 pages).

"MG5193-Alphatron Tunable S-Band Magnetron". E2V Technologies Limited. AIA-MG5193-Alphatron Issue 1, Jun. 2003. Available at http://www.alphatrononline.com/images/pdfs/MG5193_alphatron.pdf; pp. 1-7.

Jackson, John David, "Classical Electrodynamics". John Wiley & Sons, Inc. Chapter 8 Wave Guides and Resonant Cavities, pp. 334-350. Second Edition, Published 1975.

Semple, Erin, "Monitoring For Nuclear Materials". Government Security. Aug. 1, 2005. (2pages).

Gongyin, Chen, "Understanding X-ray Cargo Imaging". Nuclear Instruments and Methods in Physics Research B. Science Direct. Available online. Aug. 19, 2005, pp. 810-815.

Gongyin et al, Dual-Energy X-ray Radiography For Automatic High-Z Material Detection. Science Direct. Available online. Apr. 11, 2007, pp. 356-359.

Office Action dated Mar. 28, 2013 issued in corresponding Chinese Patent Application No. 200980136502.4.

Japanese Office Action dated Oct. 1, 2013 in JP Patent Application No. 2011-522988.

Russian Decision on Grant dated Aug. 22, 2013 in Russian Patent Application No. 2011109201/07(013388).

* cited by examiner

INTERLACED MULTI-ENERGY RADIATION SOURCES

RELATED APPLICATIONS

The present application is a continuation of U.S. patent application Ser. No. 12/228,350, which was filed on Aug. 12, 2008 and will issue on May 22, 2012 bearing U.S. Pat. No. 8,183,801, which is assigned to the assignee of the present application and is incorporated by reference herein.

FIELD OF THE INVENTION

This invention relates generally to radiation sources, and more specifically, to interlaced multiple energy radiation sources.

BACKGROUND OF THE INVENTION

Radiation is commonly used in the non-invasive inspection of contents of objects, such as luggage, bags, briefcases, cargo containers, and the like, to identify hidden contraband at airports, seaports, and public buildings, for example. The contraband may include hidden guns, knives, explosive devices, illegal drugs, and Special Nuclear Material, such as uranium and plutonium, for example. One common inspection system is a line scanner, where the object to be inspected is passed through a fan beam or pencil beam of radiation emitted by a source of X-ray radiation. Radiation transmitted through the object is attenuated to varying degrees by the contents of the object and detected by a detector array. Attenuation is a function of the type and amount (thickness) of the materials through which the radiation beam passes. Radiographic images of the contents of the object may be generated for inspection, showing the shape, size and varying amounts of the contents. In some cases the material type may be deduced.

The inspection of cargo containers at national borders, seaports, and airports is a critical problem in national security. Due to the high rate of arrival of such containers, 100% inspection requires rapid imaging of each container. Standard cargo containers are typically 20-50 feet long (6.1-15.2 meters), 8 feet high (2.4 meters), and 6-9 feet wide (1.8-2.7 meters). Larger air cargo containers, which are used to contain a plurality of pieces of luggage or other cargo to be stored in the body of an airplane, may be up to about 240×118×96 inches (6.1×3.0×2.4 meters). MeV radiation sources are typically required to generate radiation with sufficient energy to penetrate through standard cargo containers and the larger air cargo containers.

MeV radiation sources typically comprise a particle accelerator, such as a linear radiofrequency ("RF") particle accelerator, to accelerate charged particles, and a source of charged particles, such as an electron gun, to inject charged particles into the accelerator. The linear accelerator may comprise a series of linearly arranged, electromagnetically coupled resonant cavities in which standing or traveling electromagnetic waves for accelerating the charged particles are supported. The charged particles injected into the resonant cavities are accelerated up to a desired energy and directed toward a conversion target to produce radiation. Where the accelerated charged particles are electrons and the target is a heavy material, such as tungsten, Bremsstrahlung or X-ray radiation is generated. Electrons accelerated to a nominal energy of 6 MeV and impacting tungsten, will cause generation of X-ray radiation having an energy of 6 MV, for example.

A microwave (RF) power source provides RF power to the cavities of the accelerator. The microwave source may be an oscillating microwave power tube, such as a magnetron, or an amplifying microwave power tube, such as a klystron. The microwave sources are powered by modulators, which generate high electric power pulses having peak electric powers of from 1 MW to 10 MW, and average powers of from 1 kW to 40 kW, for example.

Characteristics of the modulator output may be varied to vary the output of the microwave power source. For example, the amplitude of the high-voltage pulses driving the oscillator or the amplifier may be varied to change the microwave power output. Alternatively, in an amplifier, the microwave input signal may be varied to change the microwave power output.

The accelerator, which may have a loaded Q value of 5000, for example, is very sensitive to the frequency of the input RF power. Maximum acceptance of microwave power provided by the RF source is achieved when the center frequency of the microwave power matches the accelerator resonance frequency. Otherwise, some or most of the microwave power provided to the accelerator will be reflected, preventing acceleration of the charged particles to the desired beam energy. The RF frequency may be adjusted to match the accelerator resonance frequency by a mechanical or electrical tuner.

The RF power provided to the accelerator causes heating and expansion of the accelerator structure, which causes a slow frequency drift of the accelerator resonance frequency. Such drift is most noticeable in the first minute or two of operation, but may continue due to environment conditions.

An automatic frequency controller ("AFC") is generally required to servo the RF source frequency to track the accelerator resonance frequency, as is known in the art. The AFC samples and compares microwave signals provided to the accelerator with those reflected from the accelerator, to determine the required tuning of the microwave source. An AFC is generally sufficient to match the frequency of the RF source to the resonance frequency of the accelerator, during steady state operation. An example of an AFC is described in U.S. Pat. No. 3,820,035, which is incorporated by reference herein.

When a magnetron is used, pulse to pulse frequency jitter in the magnetron may also cause a small mismatch between the frequency of a magnetron and the resonance frequency of the accelerator. Such mismatch varies from pulse to pulse and adds some noise to the system. This may be improved by feeding some microwave power reflected from the accelerator back into the magnetron by a reflector and variable phase shifter, for example, as described in U.S. Pat. No. 3,714,592, which is also incorporated by reference herein. The reflector/variable phase shifter may be referred to as a "phase wand."

It is difficult to distinguish nuclear devices and nuclear materials from other dense or thick items that may be contained within the object by standard X-ray scanning. The information that may be derived about the material type of the contents of objects by X-ray scanning may be enhanced by the use of radiation beams in the MV energy range, with two or more different energy spectra that interact differently with the material contents of the object. For example, the attenuation of a 6 MV X-ray radiation beam by the contents of the object will be different from the attenuation a 9 MV X-ray radiation beam by the same contents, due to the differing effects of Compton Scattering and induced pair production on the different energy beams. A ratio of the attenuations at the two X-ray energies may be indicative of the atomic numbers of the material through which the radiation beam passes, as described in U.S. Pat. No. 5,524,133, for example. More sophisticated dual energy analysis techniques are described in U.S. Pat. No. 7,257,188, for example, which is assigned to the assignee of the present invention and incorporated by reference herein. Ratios of high and low energy attenuations may also be plotted against object thickness to facilitate material identification, as described in "Dual Energy X-ray radiography for automatic high-Z material detection," G. Chen et al, NIM (B), Volume 261 (2007), pp. 356-359.

It would be useful to be able to generate radiation beams having different nominal energies in the MV range by a single radiation source for the dual energy inspection of cargo containers and other objects, for example. In an example of an interlaced dual energy accelerator described in U.S. Pat. No. 7,130,371 B2, different electron beam energies are achieved in a traveling wave accelerator by changing the electron beam loading and RF frequency of the accelerator in a synchronized manner and thereby changing the effectiveness of acceleration. No successful reports of field application of this approach are known, possibly due to the complexity of the system and stability issues.

SUMMARY OF THE INVENTION

A single accelerator may accelerate beams of electrons or other charged particles to different energies by being excited at two different RF power levels by the RF power generator. It may be necessary to rapidly switch the power generator between generation of two power levels. Switching on the order of a millisecond may be desirable, for example. As the RF power varies pulse to pulse, the frequency of the RF power pulses, as well as the resonance frequency of the accelerator, may also change pulse to pulse. Improved techniques for matching the frequency of the RF power pulses generated by the RF power generator to the resonance frequency of the accelerator on a pulse to pulse basis would be advantageous. Embodiments of the invention provide improved frequency control in klystron, and mechanically and electrically tuned magnetron based dual or multi-energy systems.

In accordance with one embodiment of the invention, a method of operating an accelerator is disclosed, comprising generating first radiofrequency power pulses having first powers and first frequencies, generating second radiofrequency power pulses having second powers and second frequencies different than the first powers and first frequencies, and providing the first and second radiofrequency power pulses to resonant cavities of a single accelerator in a predetermined sequence. The method further comprises matching the first frequency of the first radiofrequency power pulses to a first resonance frequency of the accelerator while providing the first radiofrequency power pulses to the accelerator, and matching the second frequency of the second radiofrequency power pulses to a second resonance frequency of the accelerator different from the first resonance frequency while providing the second radiofrequency power pulses to the accelerator.

In accordance with a related embodiment, a method of generating radiation at multiple energies is disclosed comprising sequentially providing first electric power and second electric power to a microwave power generator. The second electric power is different from the first electric power. First radiofrequency power pulses having a first power at a first frequency and second radiofrequency power pulses having a second power different than the first power and a second frequency different than the first frequency, based at least in part, on the first and second electric powers, are sequentially generated by the power generator. The first and second radiofrequency power pulses are sequentially provided to resonant cavities of a single particle accelerator. The method further comprises matching the first frequency of the first radiofrequency power pulses to a first resonance frequency of the accelerator while providing the first radiofrequency power pulses to the accelerator, and matching the second frequency of the second radiofrequency power pulses to a second resonance frequency of the accelerator different from the first resonance frequency while providing the second radiofrequency power pulses to the accelerator. Charged particles are injected into the resonant cavities of the accelerator, and are sequentially accelerated by the accelerator to a first energy at a first resonance frequency of the accelerator and to a second energy at a second resonance frequency of the accelerator different from the first resonance frequency based, at least in part, on the first and second radiofrequency power pulses. The first and second accelerated charged particles are sequentially collided with a target to generate radiation having first and second respective energies.

In accordance with another embodiment of the invention, a multi-energy radiation source is disclosed comprising an accelerator to accelerate charged particles, a charged particle source coupled to the accelerator to provide charged particles to the accelerator, and a target downstream of the accelerator. Impact of the accelerated charged particles on the target causes generation of radiation. The source further comprises a power generator coupled to the accelerator to selectively provide first and second radiofrequency power pulses to the accelerator. The second radiofrequency power pulses have a different power and frequency than the first radiofrequency power pulses. The source further comprises first means for matching a first frequency of the power generator to a first resonance frequency of the accelerator while the first radiofrequency power pulses are provided to the accelerator, and second means for matching a second frequency of the power generator to a second resonance frequency of the accelerator while the second radiofrequency power pulses are provided to the accelerator. Impact of the first charged particles on the target causes generation of radiation at a first energy and impact of the second charged particles on the target causes generation of radiation at a second energy different from the first energy.

In accordance with another embodiment, a method of generating radiation at multiple energies and doses is disclosed comprising sequentially providing first electric power and second electric power to a microwave power generator, the second electric power being different from the first electric power, sequentially generating by the power generator first radiofrequency power pulses having a first power and second radiofrequency power pulses having a second power different than the first power, based at least in part, on the first and second electric powers, and sequentially providing the first and second radiofrequency power pulses to resonant cavities of a single particle accelerator. The method further comprises sequentially driving a charged particle source at a third electric power and a fourth electric power different from the first electric power, injecting first and second currents of charged particles into the resonant cavities of the accelerator, wherein the first and second currents are based, at least in part, on the third and fourth electric powers, respectively, and sequentially accelerating by the accelerator the injected charged particles to a first energy and to a second energy different from the first energy based, at least in part, on the first and second radiofrequency power pulses The first and second currents of accelerated charged particles are collided with a target to generate radiation having first and second different energies and first and second, different, respective dose rates.

In one example of an embodiment of the invention, in interlaced operation of a mechanically tuned magnetron based accelerator system, an AFC is used to adjust the magnetron frequency, at one power level. For example, the magnetron tuning may be adjusted by the AFC so that the frequency of high RF power pulses generated by the magnetron matches the accelerator resonance frequency when high RF power pulses are provided to the accelerator. At the other RF power level, in this example the low RF power pulses, the magnetron is operated at conditions under which it undergoes a frequency shift that at least partially matches the resonance frequency shift of the accelerator while the low RF power pulses are provided to the accelerator. The conditions may include the amplitude of the voltage of the electric power pulses provided to the magnetron from the modulator. The conditions may further include maintaining the magnetic field of the magnetron constant. A phase wand may further match the magnetron frequency to the resonance frequency, if needed, for both the high and low energy pulses. The AFC may be used during the low energy pulses and the magnetron may be operated under conditions that the magnetron frequency shift matches the accelerator resonance frequency shift during the high RF power pulses, instead.

In another example of embodiment of the invention, in an electrically tuned magnetron or a klystron based system, two independent AFC controls may be used to determine the reference voltages for magnetron or RF driver frequency control for the high RF power pulses and the low RF power pulses, respectively. Those voltages are then used to control the magnetron or RF driver frequency on a pulse by pulse basis.

In accordance with another embodiment, different electron beam currents may be provided for different energy beam pulses to achieve desired dose output for each energy pulse, by controlling the particle source, such as an electron gun, on a pulse by pulse basis. For a diode gun or a triode gun, either the voltage pulse amplitude or timing with relative to microwave pulse can be varied. For a triode gun, grid voltage can also be varied on pulse by pulse basis.

DETAILED DESCRIPTION OF THE PREFERRED EMBODIMENTS

Figure 1:
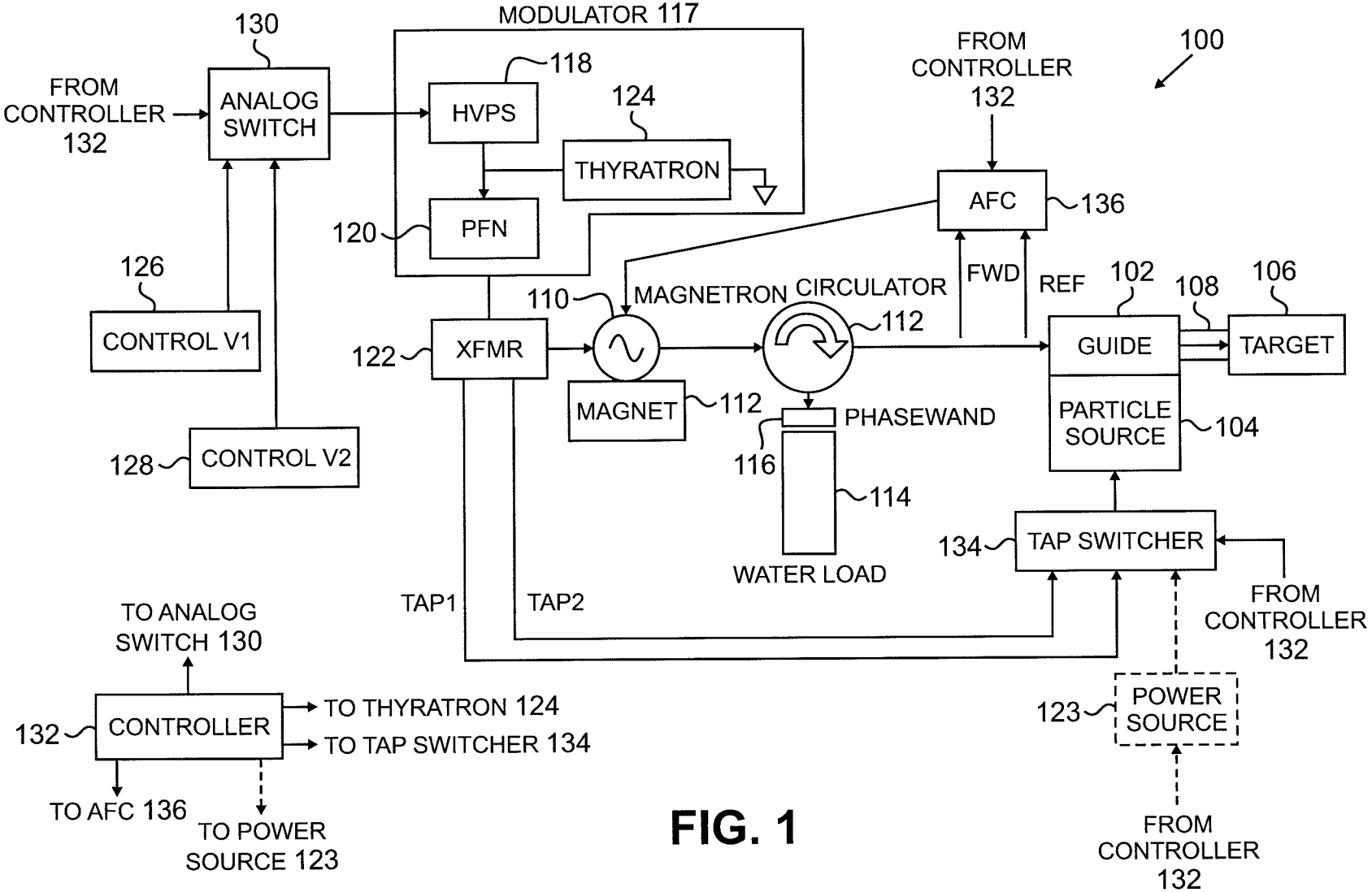
FIG. 1 is a schematic diagram of an example of multi-energy radiation source in accordance with an embodiment of the invention.

FIG. 1 is a schematic diagram of an example of multi-energy radiation source 100 in accordance with an embodiment of the invention. In this example, the radiation source 100 is configured to accelerate charged particles, such as electrons, to first and second nominal energies in an interlaced manner, and collide the accelerated charged particles with a target to generate radiation having two different energy spectra, one having a high energy, and another having a low energy, in an interlaced manner. In one example, the first nominal electron energy is 6 MeV, which causes generation of a 6 MV radiation beam (high energy in this example), and the second nominal energy is 3.5 MeV, which causes generation of a 3.5 MV radiation beam (low energy in this example), at a pulse rate of 200 or 300 pulses per second ("pps"). Other combinations of energies may be generated, such as 9 MV and 6 MV, at lower or higher pulse rates. The pulse rate may be 400 pps, for example. More than two radiation energies may be generated, such as 6 MV, 9 MV, and 15 MV, for example, in any desired sequence.

The radiation source 100 comprises a guide or accelerator 102, a charged particle source 104 coupled to the accelerator, and a target 106 coupled to the accelerator by a drift tube 108, for example. Charged particles provided to the accelerator 102 by the charged particle source 104 are accelerated by the accelerator up to a desired energy and directed toward the target 106. Impact of the accelerated charged particles with the target causes generation of radiation. The charged particles may be electrons and the charged particle source 104 may be an electron gun, such as a diode or triode electron gun, for example. The target 106 may comprise tungsten, for example. In the case of accelerated electrons impacting a heavy target material such as tungsten, the impact causes the generation of X-ray radiation, as is known in the art.

The accelerator 102 may comprise a plurality of electromagnetically coupled resonant cavities (not shown), configured such that different electromagnetic field strengths in the cavities cause electrons to be accelerated to different nominal energies, such as 6 MeV and 3.5 MeV in this example, as is known in the art. Impact of electrons accelerated to different nominal energies on the target causes generation of X-ray radiation beams having different energies, such as 6 MV and 3.5 MV, respectively, in this example, as is known in the art.

The accelerator 102 may be an electron linear accelerator comprising a plurality of axially aligned electromagnetically coupled resonant cavities (not shown), as is known in the art. The linear accelerator may be an S-band or X-band standing wave linear accelerator, for example. A suitable accelerator is an M6A series S-band linear accelerator used in the Linatron® M™ Series X-ray sources, available from Varian Medical Systems, Inc., Palo Alto, Calif., which has a nominal resonance frequency of about 2998 MHz. The M6A linear accelerator is configured to generate X-ray radiation beams having nominal energies of 6 MV and 3.5 MV. The loaded Q of the accelerator 102 may be 5000, for example. A traveling wave linear accelerator could be used, instead.

In the example of FIG. 1, the accelerator 102 is powered by microwave power, also referred to as RF power in the art, which is provided by a magnetron 110. The frequency band of the magnetron 110 is selected to match the frequency band of the accelerator 102. In this example, since the accelerator is an S-band accelerator, the magnetron 110 is configured or selected to generate RF power in the S-band, as well. A magnet 111 is positioned adjacent to the magnetron 110 to provide the required magnetic field to the magnetron, as is known in the art. The magnet 111 may have a magnetic field strength of 1500 Gauss, for example. The magnet 111 may be a permanent magnet or an electromagnet. In this example, the magnet 111 is an electromagnet that provides an adjustable magnetic field, which is kept constant during operation.

The RF power generated by the magnetron 110 is provided to the resonant cavities within the accelerator 102 in the form of individual pulses of RF power, per cycle. Each pulse of RF power comprises a large number of RF micropulses. The frequency of the micropulses is set in this example by mechanical tuning of the magnetron 110, and other factors described below. The RF power establishes electromagnetic standing waves within the resonant cavities. The standing waves accelerate the electrons (or other such charged particles) provided into the cavities by the electron gun 104, resulting in electron beams comprising electrons accelerated to nominal energies up to the designed maximum acceleration energy of the accelerator for the provided RF power.

In one example, the magnetron 110 generates RF power at approximately 2.6 MW and 1.5 MW, resulting in nominal accelerated electron energies of 6 MeV and 3.5 MeV, respectively, and generation of 6 MV and 3.5 MV X-ray radiation beams, respectively. In this example, the magnetron 110 is capable of switching between the RF powers at a rate of 200 pulses per second ("pps") or 300 pps, for example.

The magnetron 110 in this example may be an MG5193-Alphatron mechanically tunable S-band magnetron, available from e2v Technologies Inc., Elmsford, N.Y. ("e2v"), for example. According to information provided by e2v, the magnetron 110 can be tuned over a frequency range of 2993 MHz to 3002 MHz, has a peak output power of up to 2.6 MW, and is water cooled. The frequency range is said to be achieved by turning its mechanical tuner by 4.75 revolutions. The maximum allowed peak anode voltage is said to be 48 kV. The maximum allowed peak anode current is said to be 110 Amperes. The maximum average input electric power is said to be 6.0 KW. The pulse duration is said to be around 5.0 microseconds (μs).

A circulator 112, such as a 3-port circulator, is provided between the magnetron 110 and the accelerator 102 to isolate the magnetron from the accelerator 102 by directing RF power reflected from the accelerator away from the magnetron, toward a water load 114 coupled to the circulator, for example. The water load 114 absorbs the reflected RF power. Some of the RF power directed toward the water load is reflected back to the circulator 112, which directs that RF power toward the magnetron 110, by a phase wand 116, as is known in the art. This helps to stabilize the magnetron 110, reducing pulse to pulse frequency jitter in the magnetron 110 by pulling the frequency of the magnetron to the frequency of the accelerator 102. The phase wand 116 may be a reflector/variable phase shifter provided between the circulator 112 and the water load 114. An example of a reflector/variable phase shifter is described above and in U.S. Pat. No. 3,714,592, which is incorporated by reference herein. Such frequency pulling is effective over a narrow frequency range, such as up to about 100 kHz.

In the example of FIG. 1, the magnetron 110 is driven by a modulator 117 comprising an electric power source, such as a high voltage power supply ("HVPS") 118, a pulse forming network ("PFN") 120, and a thyratron 124. The HVPS 118 charges the PFN 120 for every pulse. The output of the PFN 120 may be provided to an optional transformer ("XFMR") 122. The thyratron 124 is connected to one end of the PFN 120 and the transformer 122 is connected to the other end. A high control voltage (Control V1) 126 and a low control voltage (Control V2) 128 are provided by voltage supplies (not shown) to an analog switch 130 between the control voltages and the HVPS 118. The analog switch 130 is configured to switch between the Control V1 and the Control V2 at the desired switching rate between the generation of X-ray radiation beams having a higher and a lower nominal energy, such as 200 pulses per second ("pps") or 300 pps, for example. The analog switch 130 may be controlled by a logic signal from a controller 132 programmed to cause switching at the desired rate and the desired time within each cycle. The selected control voltage is provided to the HVPS 118, which charges the PFN 120 to the corresponding higher or lower voltage, dependent on the control voltage received. In this example, the Control V1 is set to 8.8 volts and the Control V2 may be set to 6.4 volts, to set the high voltage to 22 kV and the low voltage to 16 kV, respectively. Other voltage settings may be selected. The controller 132 may comprise simple logic control circuitry or a processor, such as a microprocessor, for example.

After the PFN 120 has been charged by the HVPS 118 to the appropriate level and at a time required by X-ray imaging, the controller 132, or another controller, causes the thyratron 124 to conduct, releasing electric power stored in PFN 120 to the transformer 122. The output of the HVPS 118 is also shorted to ground. The HVPS 118 is designed to initiate self-protection when shorted, as is known in the art. The transformer 122 multiplies the voltage of the pulse to the level required by the magnetron 110.

In this example, the transformer 122 also drives the electron gun 104, saving the cost and complexity of providing an additional power source. The electron gun may be a diode gun, for example. A tap switcher 134 between the electron gun 104 and the transformer 122 switches between taps on the transformer 122 to connect a desired voltage to the electron gun. As is known in the art, the voltage provided to the electron gun 104 determines the electron beam current provided by the electron gun to the accelerator 102, which affects the dose rate of the generated radiation. It may be desirable to deliver the different radiation beams at different dose rates. The tap switcher 134 may switch between taps at the same rate as the analog switch 130 switches between the control voltages 126, 128. The dose rates may thereby be changed on a pulse by pulse basis, if desired. The tap switcher 134 may be controlled by the controller 132 or by another controller.

Part of the voltage provided by the HVPS 118 goes to the electric load, in this case the transformer 122 and the magnetron 110 connected to the secondary side of the transformer. In this example, of the 22 kV output by the HVPS 118 in this example, 11 kV goes to the load and of the 16 kV, 10 kV goes to the load. The transformer 122 raises the 11 kV and 10 kV to 44 kV and 40 kV respectively, for example, which is provided to the magnetron 110. The magnetic field is kept constant while the different RF power pulses are generated, resulting in different impedences in the magnetron 110, as is known in the art.

In this example, the transformer 122 also drives the electron gun 104 by another secondary winding. As noted above, the transformer 122 is optional. Instead, the HVPS 118 and/or the PFN 120 may be configured to generate the higher voltages.

The transformer 122 may have multiple outputs or taps for gun voltage. In this example, there are nine (9) taps on the transformer, providing nominal voltages of 1.4, 2.1, 2.8, 4.4, 6.0, 7.6, 9.0, 10.6, and 12 kV at a PFN voltage of 25 kV, for example. Two of the nine taps are connected to the input of side of tap switcher 134, based on the electron currents required to generate the desired dose rates of the high and low energy radiation beams in a particular application. The two taps may be manually selected and connected to inputs of the tap switcher 134. The transformer may be obtained from Stangenes Industries, Palo Alto, Calif., for example. The tap switcher 134, which may be a solid state tap switcher that switches at a rate of 200 pps or 300 pps in the present example, may also be obtained from Stangenes Industries of Palo Alto, Calif., for example.

A separate power source 123 (shown in phantom in FIG. 1) may be provided to drive the electron gun 104, instead of the transformer 122, to vary the power on a pulse by pulse basis. In such case, the timing of gun voltage pulse may be adjusted relative to the RF pulse, adding additional flexibility to the control of the dose output. Also, instead of using a diode gun, a triode gun may be used. In case of a triode gun, the grid voltage and timing can be adjusted, adding further flexibility to dose output control. The power source 123, if provided, may be controlled by the controller 132 or other such controller, as well.

As discussed above, the accelerator 102 is a resonant structure whose RF power acceptance is sensitive to RF frequency. The better the match between the frequency of the RF power pulses and the accelerator resonance frequency, the better the acceptance. If the match is not sufficient, the accepted RF power into the accelerator 102 may not be sufficient to adequately excite electromagnetic fields inside the accelerator cavities to accelerate the electrons to the desired energies, as is known in the art.

However, RF power provided to the accelerator 102 may heat the accelerator components, causing expansion that may shift the resonance frequency. Other factors that may cause the resonance frequency to vary include vibrations of the accelerator 102. The RF output frequency of the magnetron 110 must therefore be changed to match the resonance frequency, to ensure that sufficient RF power will be accepted by the accelerator 102.

In the multi-energy source of the present invention, the resonance frequency of the accelerator 102 shifts on a pulse by pulse basis in response to differential heating of the accelerator by the differing RF powers sequentially provided by the magnetron 110. In particular, the accelerator temperature is higher after the high power RF pulse than after the low power RF pulse, causing differential expansion of the components of the accelerator 102, from pulse to pulse. Such differential expansion changes the resonance frequency of the accelerator 102 when the following RF pulse arrives. At the two power level settings in this example, the resonance frequency has been found to shift by about 200 kHz, such as from about 2998 MHz to about 2998.2 MHz and back to about 2998 MHz, for example, from each high to low to high pulse of RF power.

An automatic frequency controller ("AFC") 136 samples RF power pulses that go to (FWD) and are reflected from (REF) the accelerator 102, at a location between the circulator 112 and the accelerator 102, to detect the frequency matching condition and adjust magnetron frequency tuner if necessary to match the resonant frequency of the accelerator. The FWD RF signal may be sampled between the magnetron 110 and the circulator 112 instead, and REF RF signal can be sampled between the circulator 112 and the load 114 instead. The sampling times may be controlled by the controller 132 or other such controller, for example.

The AFC 136 may be based on a quadrupole hybrid module and an adjustable phase shifter, which are commercially available. AFCs of this type are described in U.S. Pat. No. 3,820,035, which is incorporated by reference herein, for example. In the system described, a microwave circuit accepts a reflected ("REF") signal, and a forward ("FWD") signal, and generates vector sums of the two signals with various relative phase shifts. The amplitude of those vector sums are measured and the need to adjust RF source frequency is determined by electronic circuitry or software. The output signal of the AFC 136 may be employed in a feedback loop to the mechanical tuner (not shown) of the magnetron 110. Over multiple cycles, the magnetron frequency approaches the resonance frequency of the accelerator.

It has been found that at the desired pulse rates of 200 pps to 300 pps and faster, the mechanical tuning of the magnetron 110 is not fast enough to respond to automatic frequency control for every pulse of RF power. Automatic frequency control of a mechanically tunable magnetron 110 may not be sufficient at slower pulse rates, either. Therefore, in accordance with this embodiment of the invention, the mechanical tuner of the magnetron 110 is only set by the AFC 136 to a position to match the frequency of only one type of RF power pulse, in this example the high RF power pulse.

The different voltages provided to the magnetron 110 cause different charge densities within the magnetron, causing a frequency shift known as "frequency pushing" in the art. The different voltages also differentially heat the magnetron 110, which may also cause frequency shifts. It has been found that with proper selection of the amplitudes of the voltage pulses provided to the magnetron 110, particularly when operated at constant magnetic field from pulse to pulse, the frequency shift in the magnetron 110 will be in the same direction and of nearly the same or the same quantity (about 200 KHz in this example), as the resonance frequency shift in the accelerator 102. Remaining frequency mismatch up to about 100 KHz may be matched by the action of the phase wand 116, which further adjusts the magnetron frequency toward the accelerator resonance frequency.

Figure 2:
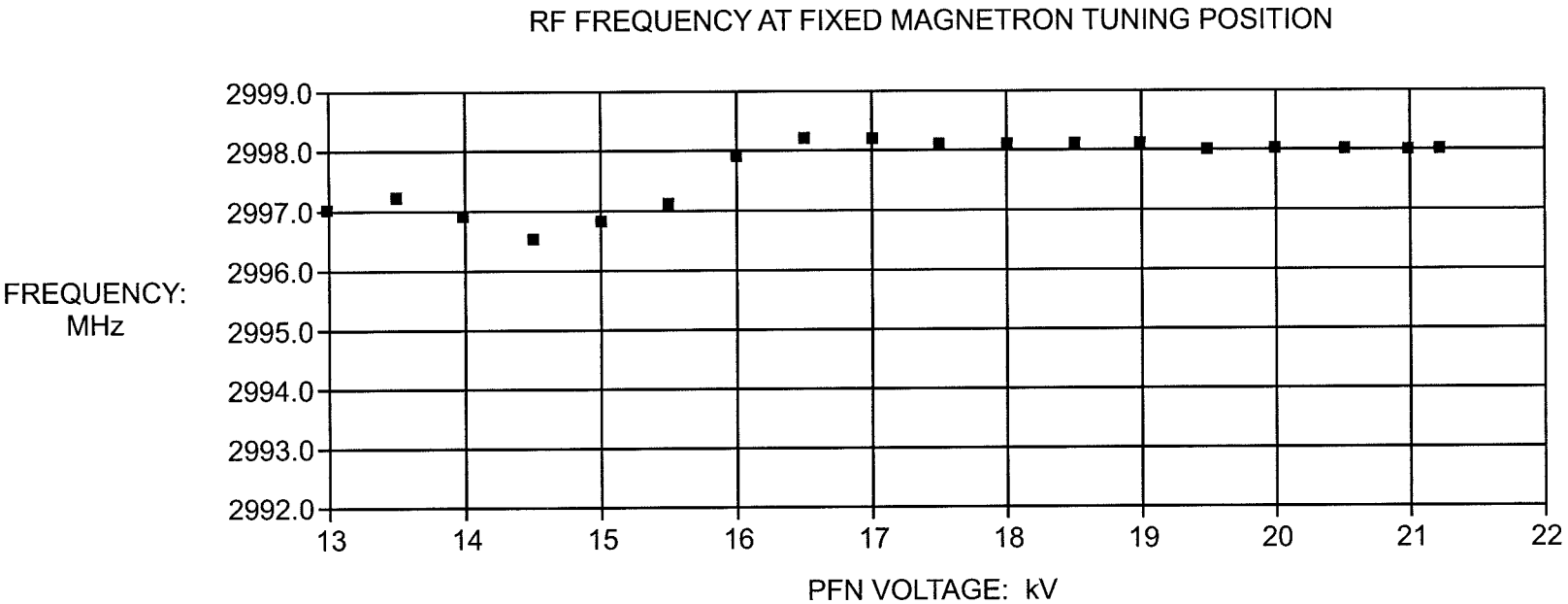
FIG. 2 is a graph of an example of PFN voltage provided to a magnetron versus magnetron frequency (MHz)

FIG. 2 is a graph of PFN voltage provided to the magnetron 110 by the PFN 120 versus magnetron frequency (MHz) for voltages ranging from 13 kV to 22 kV, and frequencies of 2992.0-2999.0 MHz, at a constant magnetic field of 1450 Gauss. This data was collected with the same magnetron model described above, which was not connected to the resonant load of an accelerator at the time. The magnetron tuner was fixed at a position to generate 2998 MHz RF power pulses at about 22 kV PFN voltage. Since it may be desirable to have large energy separation between radiation beams in dual energy X-ray imaging to enable better material discrimination, it is desirable that the PFN voltages selected to drive the magnetron be as far apart as feasible, for a particular accelerator. As shown in FIG. 2, at a PFN voltage of 21.5 kV, the magnetron frequency is tuned to 2998.0 MHz, which is near to the nominal resonance frequency of the accelerator 102. As the PFN voltage decreases from 21.5 kV, the magnetron frequency increases up to about 200 KHz at 16.5 kV. As the PFN voltage decreases from 16.5 kV to 14.5 kV, the magnetron frequency falls from about 2998.2 MHz to about 2996.5 MHz. The magnetron frequency then rises and falls again as the PFN voltage decreases from 14.5 kV to 13 kV.

As discussed above, the resonance frequency increases by about 200 KHz in this example from the high RF power pulse to the low RF power pulse. Since the frequency shift in the magnetron in the voltage range of from 16.5 kV to 20 kV also increases frequency, selection of the second, low RF power pulse voltage in this range enables at least partial matching of the frequency of the magnetron 110 to the frequency of the accelerator during the low RF power pulses. Further matching would be provided by the effect of the phase wand 116. The frequency increase of about 200 KHz at 16.5 kV provides a close match to the resonance frequency shift, which may be further improved by the effect of the phase wand 116. In combination with the automatic frequency control of the high RF power pulse in this example, good frequency matching is provided pulse to pulse. It is noted that automatic frequency control may be used to match the low RF power pulse frequency to the accelerator resonance frequency and magnetron frequency shift and the phase wand 116 may be used to match the high RF power pulse frequency to the accelerator resonance frequency, instead.

Figure 3:
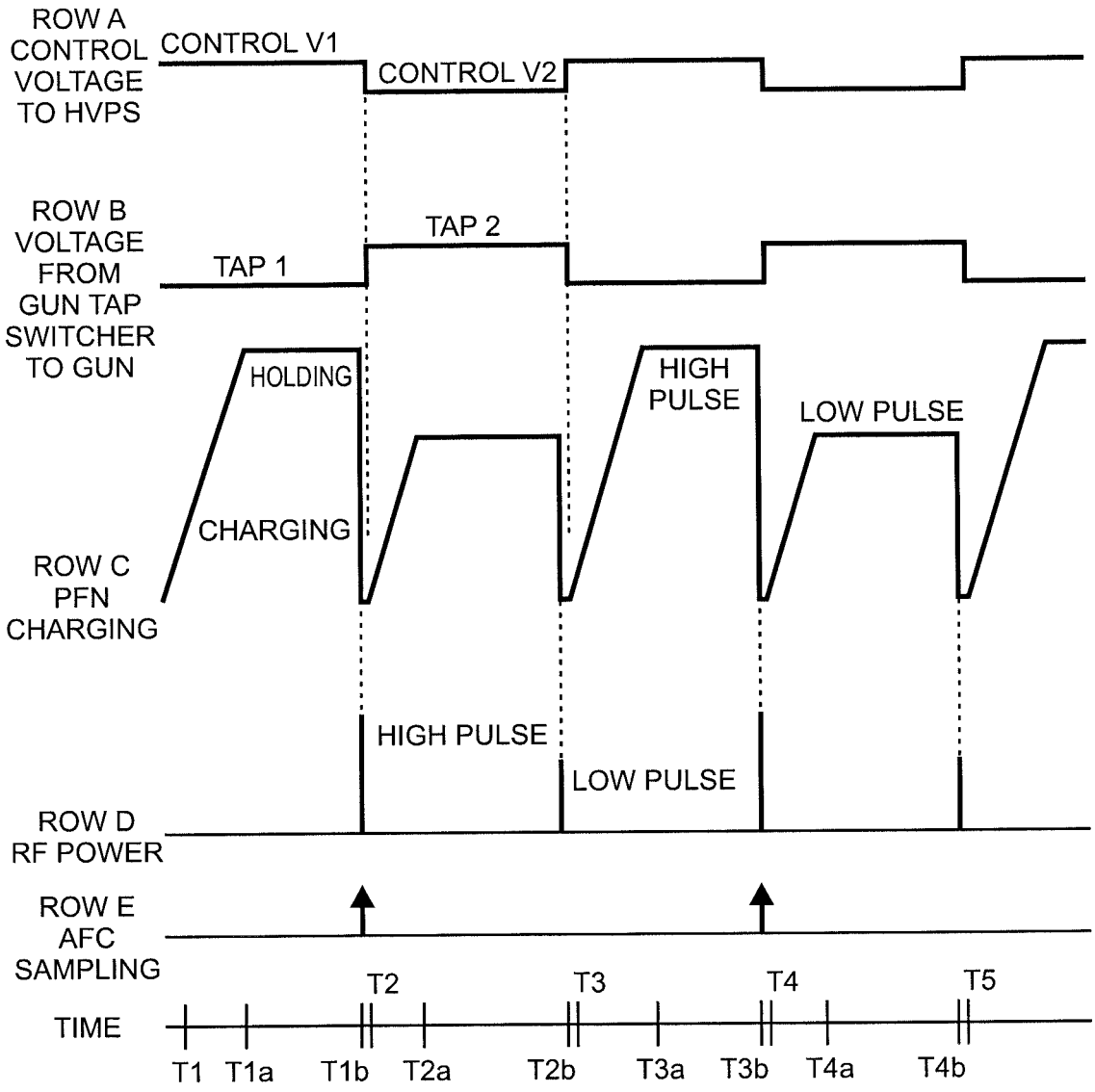
FIG. 3 is an example of the waveforms and signal timing for the radiation source of FIG. 1.

FIG. 3 is an example of the waveforms and signal timing for the radiation source 100 of FIG. 1. Row A shows the voltage waveform provided by the analog switch 130 to the HVPS 118. Row B shows the voltage waveform provided by the tap switcher 134 to the electron gun 104. Row C shows the voltage waveform across the PFN 120. Row D shows the high and low power RF pulses emitted by the magnetron 110. Row E shows the timing of AFC 136 sampling of the FWD and REW signals.

Each pulsing cycle starts when the HVPS 118 has recovered from the prior pulse. At a time T1, the HVPS 118 starts to charge the PFN 120, at a rate determined by HVPS current and PFN load to a peak voltage determined by the Control V1 126, such as 22 kV, for example. At a time T1*a*, the PFN 120 has been charged to the peak voltage. The voltage is held at that level until at a time T1*b*, when the thyratron 124 conducts and causes electric power stored in the PFN 120 to be released to the magnetron 110 and the gun 104 through the transformer 122 in the form of a pulse. Upon receipt of the electric power from the PFN 120 at about the time T1*b*, the magnetron 110 generates RF power and provides it to the accelerator 102, and electrons are injected from the gun 104 to the accelerator 102. Injected electrons are accelerated by the standing electromagnetic waves in the resonant cavities of the accelerator 102 to a nominal energy of 6 MeV in this example, exit the accelerator, and impact the target 106, causing generation of X-ray radiation having an energy of 6 MV, at a first dose rate, also at about the time T1*b*.

Also at the time T1*b*, the HVPS 118 senses that its output is shorted to the ground and initiates self protection, blocking charging of the PFN 120 from the time T1*b* to a time T2. The thyratron 124 also recovers to a non-conducting status after PFN discharge.

After the blocking period ends at the time T2, the HVPS 118 is ready to charge the next pulse. At about the same time, the analog switch 130 flips the control voltage to the HVPS 118 from Control V1 126 to Control V2 128. Also at about the time T2, the tap switcher 134 flips from connecting the tap 1 to the gun 104 to connecting the tap 2 to the gun 104. The HVPS 118 then charges the PFN 120 to the second peak voltage determined by the Control V2 128, such as 16 kV, for example. At the time T2*a*, the PFN 120 has been charged to the peak voltage. The time period from T2 to T2*a* may be different than the time period from T1 to T1*a* because the PFN 120 is charged to a different voltage. The voltage is held at the peak voltage until a time T2*b*, when the thyratron 124 again conducts and causes electric power stored in the PFN 120 to be released to the magnetron 110 and the gun 104 through the transformer 122. The magnetron 110 generates RF power and provides it to the accelerator 102, and electrons are injected from the gun 104 to the accelerator. The RF power generated by the magnetron 110 and the electron current injected from the gun 104 to the accelerator 102 at the time T2*b* are different from the generated RF power and emitted electron current at the time T1*b* in the previous pulse, in this example. Injected electrons are accelerated by the accelerator 102 to a nominal energy of 3.5 MeV in this example, exit the accelerator, and impact the target 106, causing generation of X-ray radiation having an energy of 3.5 MV, at a second dose rate different from the first dose rate, also at about the time T2*b*.

Also at the time T2*b*, the HVPS 118 senses that its output is shorted to the ground, initiates self protection, and blocks PFN charging. The thyratron 124 also recovers to non-conducting status after PFN discharge. After the blocking period ends at the time T3, the HVPS 118 is ready to charge the next pulse, to cause generation of a high RF power pulse and resulting generation of another high energy radiation beam. At about the same time, the analog switch 130 flips the control voltage from the Control V2 128 to the Control V1 126. Also at about the time T3, the tap switcher 134 flips to connect the tap 1 to the gun 104, to provide the voltage associated with the tap 1 into the gun. The pulse cycles are repeated to generate high and low power RF pulses, and high and lower energy radiation beams having different dose rates, if desired, in an interlaced manner.

The analog switch 130 and the gun tap switch 134 do not have to switch at exactly the times T1, T2, etc. Switching may be programmed to happen sooner, but not before the PFN 120 has fully discharged the previous pulse. Switching may also be programmed to happen later, but not after the HVPS 118 has charged the PFN 120 to the desired voltage.

In this example, at a pulse rate of 300 pps, the charging time periods for the high power pulse T1-T1*a*, T3-T3*a* . . . of the PFN 120 are about 1.5 milliseconds, and the charging time periods for the low power pulses T2-T2*a*, T4-T4*a* . . . are about 1.1 milliseconds, for example. The charging time and the hold time for each high voltage pulse T1-T1*b*, T3-T3*b* . . . are about 3.2 milliseconds. The charging time and the hold time for each low voltage pulse T2-T2*b*, T4-T4*b* . . . are also about 3.2 milliseconds. It takes the PFN 120 from about 1.5 to about 5 microseconds to release its stored electric power to the magnetron 110 and the gun 104 through the transformer 122. RF power is generated by the magnetron 110 and provided to the accelerator 102, and electrons are injected from the gun 104 to the accelerator 102, during the time the energy is released from the PFN 120. The HVPS 118 blocking recovery periods T1*b*-T2, T2*b*-T3, T3*b*-T4 are each about 100 microseconds.

While an alternating sequence of one high RF power pulse followed by one low RF power pulse followed by another high RF power pulse, etc. is shown above, resulting in an alternating sequence of high and low energy radiation beams, any desired sequence may be implemented. For example, the alternating sequence may comprise two high RF power pulses followed by two low RF power pulses, or one high RF power pulse followed by two low RF power pulses, etc., resulting in corresponding alternating sequences of high and low energy radiation beams.

Figure 4:
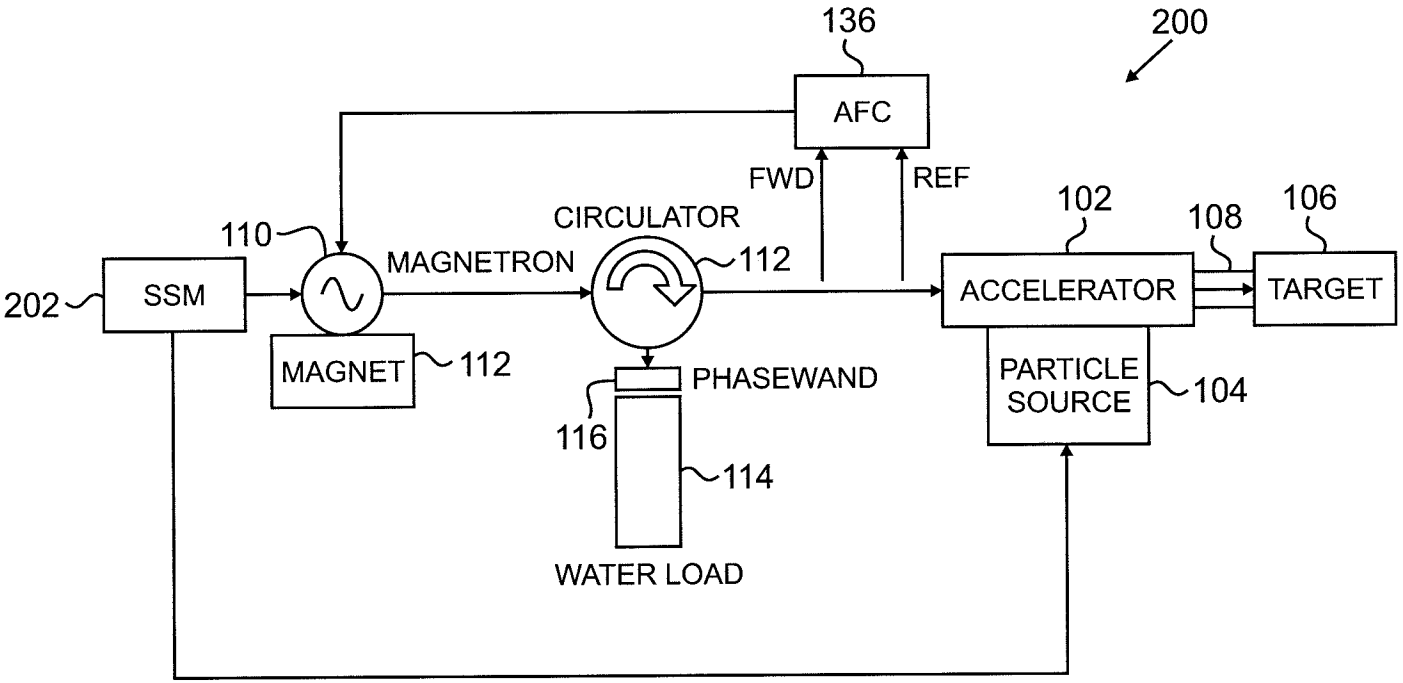
FIG. 4 is another example of a multi-energy radiation source in accordance with the embodiment of FIG. 1, including a solid state modulator ("SSM")

FIG. 4 is another example of a multi-energy radiation source 200 in which a solid state modulator ("SSM") 202 is used instead of the modulator 117 defined by the HVPS 118, PFN 120, and thyratron 124 in FIG. 1, to drive the magnetron 110 at the desired voltage levels. Components common to the example of FIG. 1 are commonly numbered. The controller 132 is not shown to simplify illustration. In this example, no transformer is provided, although that is an option. The SSM 202 may include a digital switch or a separate switch may be provided (not shown). The controller 132 (not shown), or one or more other such controllers, may control operation of the SSM 102, as well as the other components of the system 200, as described above. The SSM 202 would deliver pulsed electric power (a series of high and low voltage pulses) at times T1*b*, T2*b*, etc., corresponding to the output of the PFN 120, shown in Row C of FIG. 3. The remainder of the components of the source 200 and their operation may be the same as in FIG. 1. As discussed above, the particle source 104, such as an electron gun, may be driven by a separate electric power source.

Figure 5:
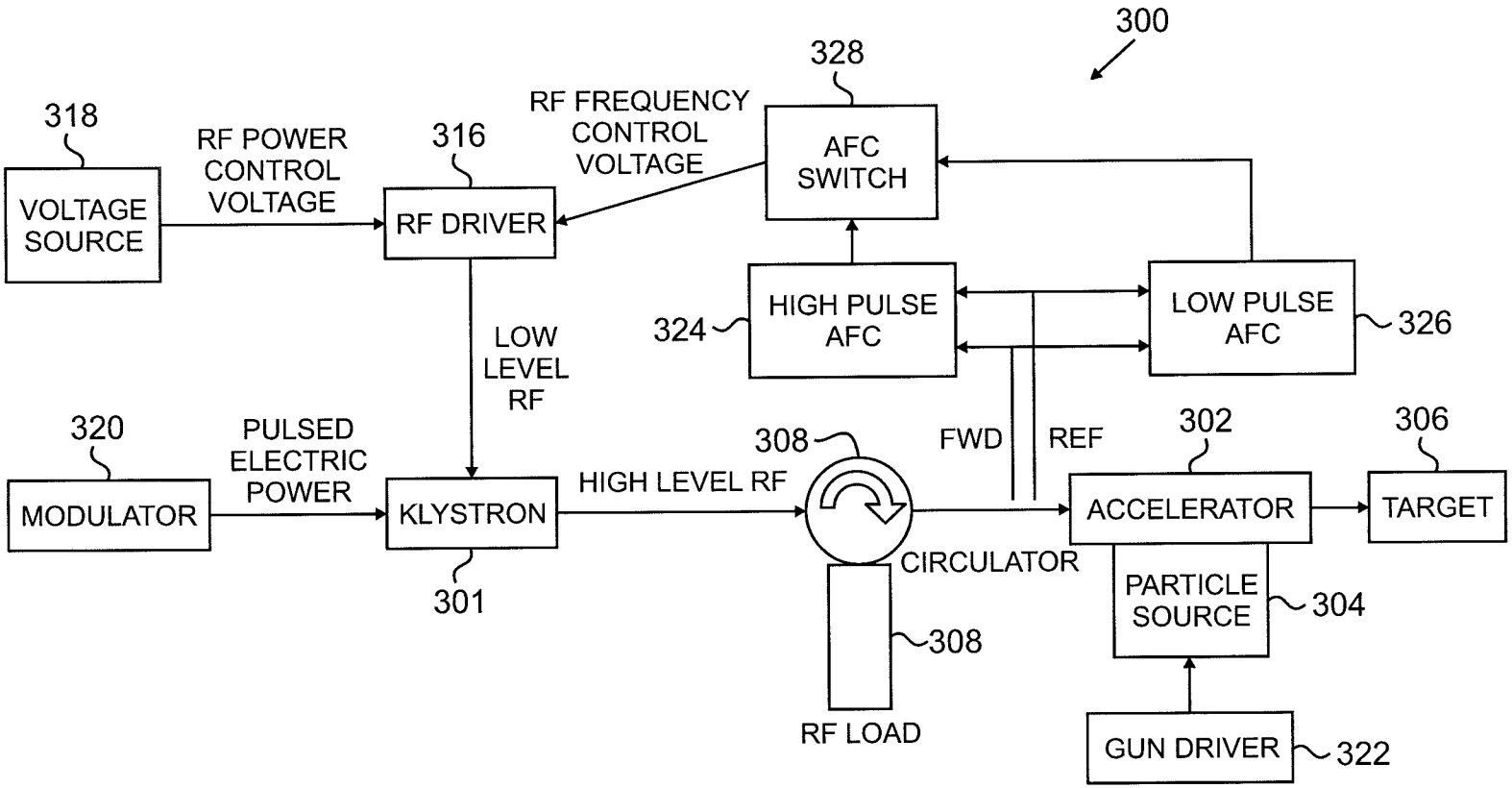
FIG. 5 is a schematic diagram of another example of a multi-energy radiation source, in accordance with an embodiment of the invention, in which a klystron is used to drive an accelerator.

FIG. 5 is a schematic diagram of another example of a multi-energy radiation source 300, in which a klystron 301 is used to drive an accelerator 302, instead of the magnetron 110, shown in FIGS. 1 and 3. The source 300 also comprises a charged particle source 304, such as an electron gun, a target 306, a circulator 308, and an RF load 310, such as water, as in the example of FIG. 1. No phase wand is needed in this example. A controller, such as the controller 132 shown in the system 100 of FIG. 1, is not shown to simplify illustration.

An RF driver 316 is also coupled to the klystron 312 to provide low level RF power to the klystron 301, such as 100 W, for example. The output of the RF driver 316 may be controlled by an input voltage provided by a voltage source 318, as known in the art. A modulator 320 is also coupled to the klystron 301, to provide pulses of electric power to the klystron. In this example, a gun driver 322 is coupled to the gun 304 to provide the required voltage pulses to the gun.

The klystron 301 amplifies the low level RF power to a higher power to excite the accelerator 302. For example, the klystron 301 may amplify the input power of 100 W to about 5 MW. The output RF power of the klystron 301 may be varied on a pulse by pulse basis to vary the excitation RF power provided to the accelerator 302 by either varying the output power of the RF driver 316, or by varying the electric power provided to the klystron by the modulator 320 (as in the magnetron example of FIGS. 1 and 3, for example).

For example, if two different levels of RF power are provided to the klystron 301 by the RF driver 316, dependent on the power level to be provided to the accelerator 302, the electric power pulses provided to the klystron 301 by the modulator 320 would have the same amplitude. The low level RF power pulses from the RF driver 316 may be 60 W and 100 W, and the corresponding high level RF power from the klystron 301 may be 3 MW and 5 MW, for example.

If the RF power pulses provided to the klystron 301 by the RF driver 316 have a constant amplitude, the electric power pulses provided by the modulator 320 would vary between two different amplitudes.

RF driver output frequency is typically controlled by a reference voltage, as known in the art. In accordance with this embodiment of the invention, two automatic frequency controllers ("AFC") 324, 326 are used to track the two accelerator resonance frequencies for high power pulses and low power pulses, respectively. Each AFC 324, 326 samples the RF power provided in a forward direction (FWD) to the accelerator 302 and the RF power reflected (REF) from the accelerator, from a location between the circulator 306 and the accelerator. Alternatively, FWD RF signals for AFCs 324, 326 may be sampled between the klystron 301 and the circulator 308, and REF RF signal may be sampled between the circulator 308 and the load 310.

The reference voltages from the two AFCs may be provided to the RF driver 316 to adjust its frequency in interlaced manner, with high power pulse AFC 324 in effect during generation of high power RF pulses and low power pulse AFC 326 in effect during generation of low RF power pulses. The high power pulse AFC 324 determines the reference voltage that should be sent to the RF driver so that high power pulses match the resonance frequency of the accelerator 302 while high power pulses are provided to the accelerator, and the low power pulse AFC 326 determines the reference voltage that should be sent to the RF driver so that low power pulses match the resonance frequency of the accelerator while low power pulses are provided. An AFC switch 328 switches between the high pulse AFC 324 and the low pulse AFC 326, to selectively provide the feedback to the RF driver 316. The AFC switch 328 switches between an input node 1 and an input node 2 to connect the frequency control reference voltage input of the RF driver 316 to the high pulse AFC 324 output and the low pulse AFC 326 output, respectively, under the control of a controller, such as the controllers discussed above. The AFC switch 328 may be controlled by a controller (not shown) to switch at the desired rate and at the desired times, such as the controller discussed above. Operation of other components of the system may be controlled by the controller or other such controllers, as well.

Figure 6:
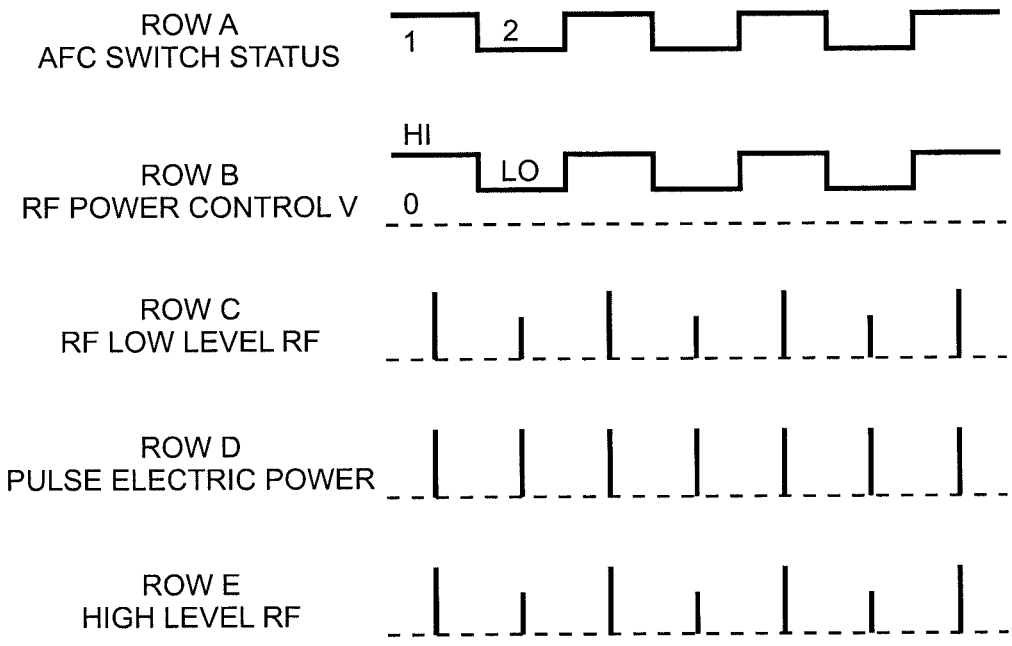
FIG. 6 is an example of waveforms and signal timing for the multi-energy radiation source of FIG. 5.

FIG. 6 shows the timing and waveforms for one example of the X-ray source 300 of FIG. 5. Row A shows the operation of the AFC switch 328. Row B shows the RF power control voltage from the voltage source 218 to the RF driver 316. Row C shows the low level RF pulses provided by the RF driver 316 to the klystron 301. Row D shows the pulsed electric power provided by the modulator 320, which can be a PFN or SSM, to the klystron 312. Row E shows the high level RF pulses provided by the klystron 312 to the accelerator 302.

The low level RF signals provided to the klystron 312 alternate between a high pulse and a low pulse, in Row C. In between each pulse, the AFC switch 328 switches between the high and low pulse AFCs 324, 326. At the same time the low level RF signals are provided, constant pulses of electric power are provided by the modulator 314 to the klystron 301. Alternating high and low RF power pulses are thereby generated and output by the klystron 301 to the accelerator 302, in coordination with alternating levels of voltage pulses provided by the gun driver 322 to the gun 304 (not shown in FIG. 6) to provide different electron currents to the accelerator. As above, high and low energy radiation beams at different energies and at different dose rates, if desired, are thereby generated, in an interlaced manner. Different alternating patterns of high/low RF pulses, and high/low energy radiation beams may be provided.

Figure 7:
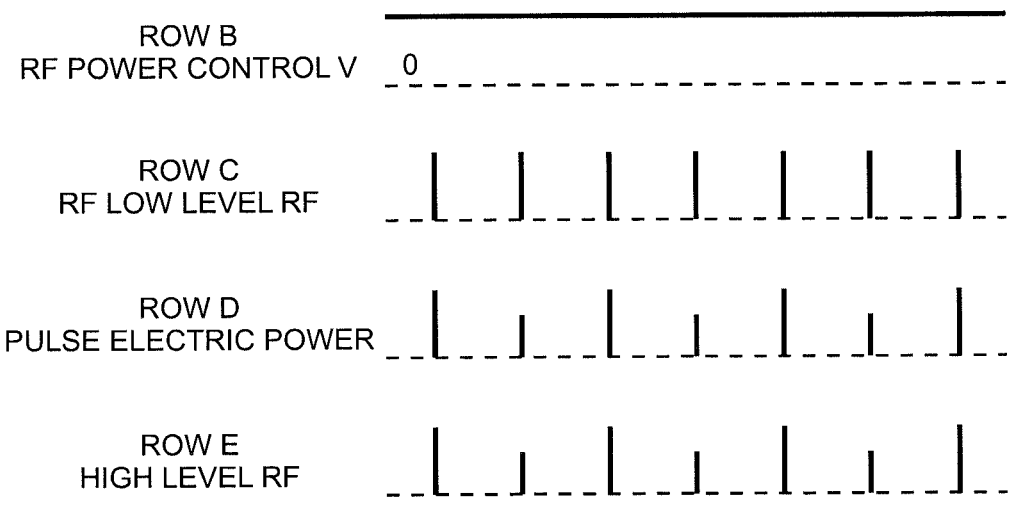
FIG. 7 is another example of waveforms and signal timing for the multi-energy radiation source of FIG. 5.

FIG. 7 shows an alternative drive scheme for the X-ray source 300 of FIG. 5, in which the RF power control voltage is constant in Row B, the low level RF pulses provided by the RF driver 316 to the klystron 301 are constant in Row C, the pulsed electric power provided by the modulator 314 to the klystron 301 varies between a high and low voltage in Row D, and corresponding high and low RF power pulses are generated and output by the klystron 301 in Row E. The AFC switching shown in Row A in FIG. 7 is the same in FIG. 6 and is not repeated. The AFC switch 328 switches between the high and low pulse AFCs 324, 326 in between the high and low power pulses provided by the modulator 314 to the klystron 301 shown in Row D. As above, high and low energy radiation beams at different energies and different dose rates, if desired, are thereby generated, in an interlaced manner. Different alternating patterns of high/low RF pulses, and high/low energy radiation beams may be provided, as above.

Figure 8:
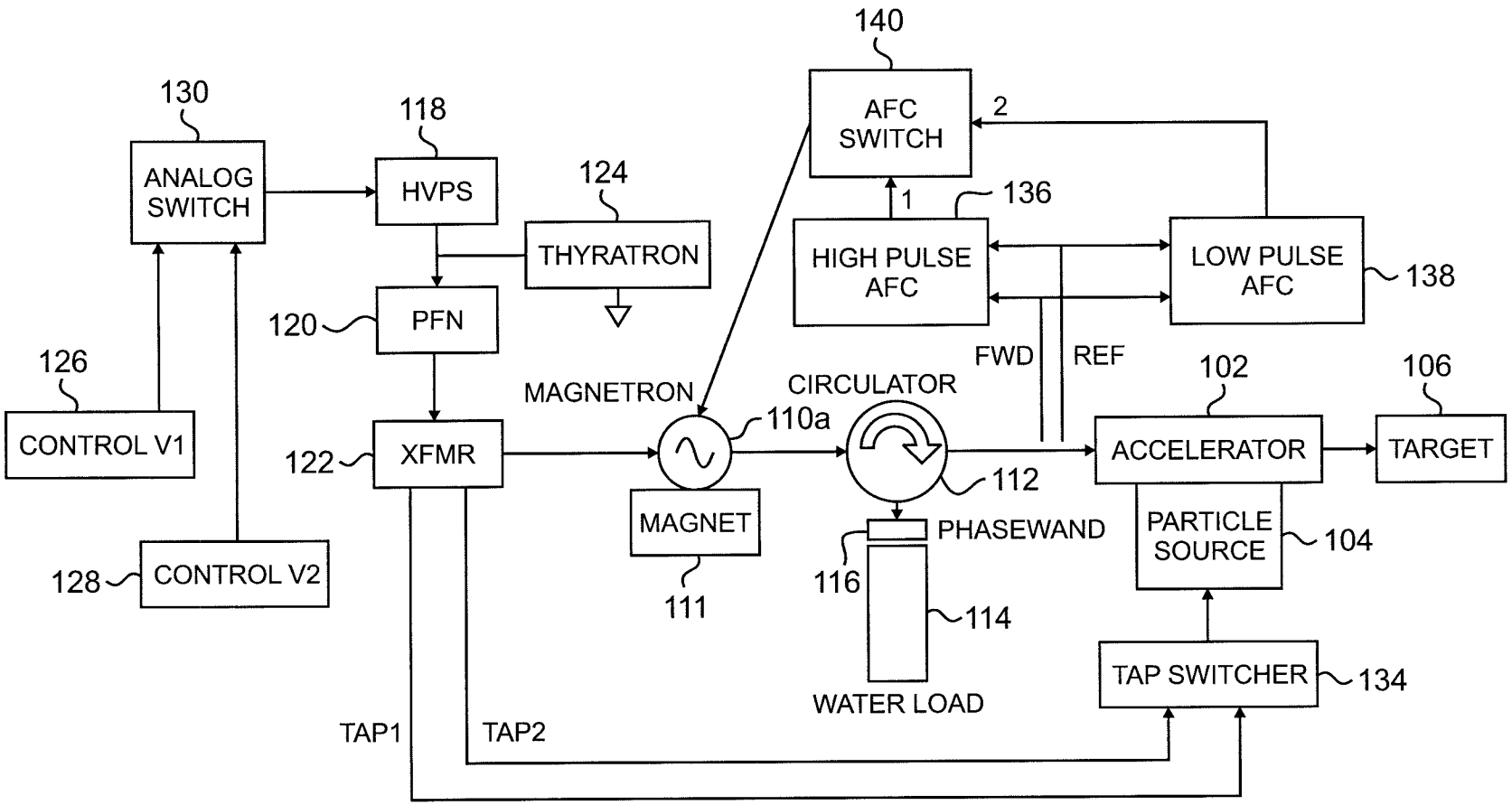
FIG. 8 is another example of a multi-energy radiation source in accordance with an embodiment of the invention, which includes an electrically tunable magnetron.

Two AFCs and an AFC switch may also be used in a similar manner to match the frequency of an electrically tuned magnetron with the resonance frequency of an accelerator. Frequency is adjustable much more quickly in an electrically tunable magnetron than in a mechanically tunable magnetron, as is known in the art. FIG. 8 is an example of a multi-energy radiation source in accordance with an embodiment of the invention, wherein the accelerator 102 is driven by an electrically tuned magnetron 110*a*. All the elements shown in FIG. 1 are provided in this example, as well, and are commonly numbered. The controller 132 of FIG. 1 is not shown in FIG. 8 to simplify illustration but it should be understood that such a controller, or other such controller or controllers, are provided in this example, as well, to control operation of the components.

In FIG. 8, in addition to the AFC 136, identified as a high pulse AFC 136, a low pulse AFC 138 is also provided, to detect the low RF power pulses reflected from the accelerator 102. The high pulse AFC 136 and the low pulse AFC 138 provide control voltages to an AFC switch 140. The switch 140 switches between providing the appropriate reference voltage from each AFC 136, 138 to the electrically tunable magnetron, to adjust the frequency of the magnetron when the high and low RF power pulses are generated, respectively. The AFC switch 140 is controlled by the controller 132 (not shown in FIG. 8) or other such controller, to switch at the appropriate times. The high pulse AFC 136 and the low pulse AFC 138 are also controlled by the controller 132 to sample the reflected RF power at the appropriate times, as discussed above with respect to the klystron based system of FIG. 5. The phase wand 116 also assists in matching the magnetron frequencies with the accelerator resonance frequencies for the high and low RF power pulses. Alternating high and low RF power pulses are generated and output by the magnetron 110*a* to the accelerator 102, in coordination with alternating levels of voltage pulses provided by the tap switcher 134 to the gun 104 to provide different electron currents to the accelerator. As above, high and low energy radiation beams are thereby generated, at different dose rates, if desired, in an interlaced manner. Different alternating patterns of high/low RF pulses, and high/low energy radiation beams may be provided, as above.

While discussed above with respect to generating radiation beams at two different energies, the system of FIG. 1 could be configured to generate radiation beams at three or more energies, by providing three or more, different control voltages to the HVPS 118. In FIG. 1, for example, if the magnetron 110 is mechanically tuned, the AFC 136 may be configured to actively adjust the frequency of RF power pulses at one of those RF power levels while the magnetron 110 may be operated to undergo frequency shifts while generating the other RF power pulses that match the resonance frequency shifts of the accelerator 102. Driving voltages may be selected for the two other power levels, as described above with respect to the low power RF pulses, for example. The phase wand 116 would also assist in matching the magnetron frequencies to the accelerator resonance frequencies. The gun 104 may also be provided with additional voltages for each different radiation beam energy, if desired, to vary the dose rate. The energy pulses may be generated in any desired sequence to cause generation of radiation beams of differing energies, in the desired pattern.

If a klystron 301 or an electrically tuned magnetron 110*a* is used as the RF power source, as in FIGS. 5 and 8, respectively, an additional AFC could be provided to adjust the frequency for power pulses for each additional power level. The AFC switch 328, 140 would be configured or controlled to feed the reference voltages into the RF driver 316 or the magnetron 110*a* in synchronization with the output RF power level, in the desired pattern.

One of the ordinary skill in the art will recognize that other changes may be made to the embodiments described above without departing from the spirit and scope of the invention, which is defined by the claims below.

We claim:

1. A method of operating an accelerator, comprising:

receiving first and second radiofrequency power pulses by resonant cavities of a single accelerator in a predetermined sequence, wherein the first and second radiofrequency power pulses have first and second different powers and first and second different frequencies, respectively;

matching the first frequency of the first radiofrequency power pulses to a first resonance frequency of the accelerator while providing the first radiofrequency power pulses to the accelerator; and matching the second frequency of the second radiofrequency power pulses to a second resonance frequency of the accelerator different from the first resonance frequency while providing the second radiofrequency power pulses to the accelerator.

2. The method of claim 1, further comprising:

generating the first and second radiofrequency power pulses by a mechanically tunable magnetron;

matching the first frequency of the first radiofrequency power pulses to the first resonance frequency of the accelerator by automatic frequency control of only the first frequency; and matching the second frequency of the second radiofrequency power pulses to the second resonance frequency of the accelerator by driving the mechanically tunable magnetron at a voltage that causes frequency shifts in the magnetron matching, at least in part, frequency shifts in the second resonance frequency of the accelerator, while generating the second radiofrequency power pulses.

3. The method of claim 2, further comprising generating the first and second radiofrequency power pulses while exposing the magnetron to a constant magnetic field.

4. The method of claim 2, further comprising matching the first and second frequencies to the first and second resonance frequencies, in part, by providing power reflected from the accelerator to the magnetron.

5. The method of claim 1, further comprising:

generating the first and second radiofrequency power pulses by a klystron or an electrically tunable magnetron;

matching the first frequency of the first radiofrequency power pulses to a first resonance frequency of the accelerator by first automatic frequency control; and matching the second frequency of the second radiofrequency power pulses to the second resonance frequency of the accelerator by second automatic frequency control different from the first automatic frequency control.

6. The method of claim 5, further comprising:

switching between matching the first frequency of the first radiofrequency power pulses to a first resonance frequency of the accelerator by the first automatic frequency control; and matching the second frequency of the second radiofrequency power pulses to the second resonance frequency of the accelerator by the second automatic frequency control.

7. The method of claim 1, further comprising:

providing first charged particles to the resonant cavities of the accelerator at a first beam current while the first radiofrequency power pulses are provided to the accelerator, to accelerate the first charged particles to a first energy; and providing second charged particles to the resonant cavities of the accelerator at a second beam current different from the first beam current while the second radiofrequency power pulses are provided to the accelerator, to accelerate the second charged particles to a second energy different from the first energy.

8. The method of claim 7, wherein the first and second first and second radiofrequency power pulses are received in an alternating pulse pattern.

9. A multi-energy accelerator, comprising:

an accelerator to accelerate charged particles;

a charged particle source coupled to the accelerator to provide charged particles to the accelerator;

a power generator coupled to the accelerator to selectively provide first and second radiofrequency power pulses to the accelerator in a predetermined sequence, wherein the second radiofrequency power pulses have a different power and frequency than the first radiofrequency power pulses;

first means for matching a first frequency of the power generator to a first resonance frequency of the accelerator while the first radiofrequency power pulses are provided to the accelerator; and second means for matching a second frequency of the power generator to a second resonance frequency of the accelerator while the second radiofrequency power pulses are provided to the accelerator.

10. The multi-energy accelerator of claim 9, wherein:

the power generator comprises a mechanically tunable magnetron;

the first means comprises an automatic frequency controller; and the second means comprises means for driving the power generator at an electric power that causes frequency shifts in the power generator matching, at least in part, frequency shifts in the second resonance frequency of the accelerator.

11. The multi-energy accelerator of claim 10, further comprising a magnet proximate the magnetron, the magnet configured to generate a constant magnetic field.

12. The multi-energy radiation source of claim 10, wherein the second means further comprises means for providing power reflected from the accelerator to the magnetron.

13. The multi-energy accelerator of claim 9, wherein:

the power generator comprises a klystron or an electrically tunable magnetron;

the first means comprises an automatic frequency controller; and the second means comprises a second automatic frequency controller different than the first automatic frequency controller.

14. The multi-energy accelerator of claim 13, further comprising:

a switch to selectively switch between the first automatic frequency controller and the second automatic frequency controller.

15. The multi-energy accelerator of claim 9, further comprising an electric power source configured to provide pulsed electric power to the power generator.

16. The multi-energy accelerator of claim 15, wherein:

the electric power source is further configured to selectively provide at least first and second, different voltages to the charged particle source, to provide at least first and second, different particle currents to the accelerator.

17. The multi-energy accelerator of claim 16, wherein:

the first voltage is provided to the particle source while the first power pulses are provided to the accelerator, to provide a first dose output of radiation having the first energy; and the second voltage is provided to the particle source while the second power pulses are provided to the accelerator, to provide a second dose output of radiation having the second energy;

wherein impact of the first charged particles on the target causes generation of radiation at a first energy and impact of the second charged particles on the target causes generation of radiation at a second energy different from the first energy.

18. The multi-energy accelerator of claim 9, further comprising:

a target, wherein impact of the first charged particles on the target causes generation of radiation at a first energy and impact of the second charged particles on the target causes generation of radiation at a second energy different from the first energy.

19. A multi-energy radiation source, comprising:

an accelerator to accelerate electrons;

an electron gun coupled to the accelerator to provide electrons to the accelerator;

a target downstream of the accelerator, wherein impact of the accelerated electrons on the target causes generation of radiation;

a source of electric power;

a mechanically tunable magnetron to selectively provide at least first and second radiofrequency power pulses to the accelerator, wherein the second radiofrequency power pulses have a different power and frequency than the first radiofrequency power pulses;

a magnet to generate a constant magnetic field, proximate the magnetron;

wherein the accelerator accelerates first electrons provided by the electron gun to a first energy at a first resonance frequency when the first radiofrequency power pulses are provided to the accelerator and the accelerator accelerates second electrons to a second energy different than the first energy, at a second resonance frequency different than the first resonance frequency, when the second radiofrequency power pulses are provided to the accelerator;

the source further comprising:

a modulator to selectively drive the magnetron at a first electric power to generate the first radiofrequency power pulses and to drive the magnetron at a second electric power different than the first electric power to generate the second radiofrequency power pulses; and an automatic frequency controller coupled to the magnetron to match the frequency of the first radiofrequency power pulses to the first resonance frequency of the accelerator while the first radiofrequency power pulses are provided to the accelerator;

wherein the modulator is configured to provide selected first and second electric powers to the magnetron such that frequency shift in the magnetron at least partially matches accelerator resonance frequency shift while the second radiofrequency power pulses are provided to the accelerator; and a phase wand between the magnetron and the accelerator, to provide reflected power from the accelerator to the magnetron to further adjust the magnetron frequency to match the resonance frequency of the accelerator;

wherein impact of the first electron beam on the target causes generation of radiation at a first energy and impact of the second electron beam on the target causes generation of radiation at a second energy different from the first energy.

20. The multi-energy radiation source of claim 19, wherein the phase wand comprises a reflector and variable phase shifter.

21. The multi-energy radiation source of claim 19, wherein:

the modulator is further configured to selectively provide at least first and second, different voltages to the electron gun;

the first voltage is provided to the electron gun while the first radiofrequency power pulses are provided to the accelerator, to provide a first beam current; and the second voltage is provided to the electron gun while the second radiofrequency power pulses are provided to the accelerator, to provide a second beam current different from the first beam current.

22. The multi-energy radiation source of claim 19, further comprising:

an electric power source separate from the modulator, coupled to the electron gun;

the electric power source being configured to selectively provide at least first and second, different voltages to the electron gun;

wherein:

the first voltage is provided to the electron gun while the first radiofrequency power pulses are provided to the accelerator, to provide a first beam current; and the second voltage is provided to the electron gun while the second radiofrequency power pulses are provided to the accelerator, to provide a second beam current different from the first beam current.

23. The multi-energy radiation source of claim 19, wherein the modulator comprises a solid state modulator.

24. The method of claim 7, further comprising:

accelerating the first charged particles by the accelerator;

impacting a target by the first accelerated charged particles to generate a first radiation beam having a first energy; and accelerating the second charged particles by the accelerator;

impacting the target by the second accelerated charged particles to generate a second radiation beam having a second energy different from the first energy.

25. The method of claim 8, further comprising:

accelerating the first charged particles by the accelerator and accelerating the second charged particles by the accelerator in a second alternating pattern corresponding to the first alternating pattern; and impacting a target by the first accelerated charged particles and the second accelerated charged particles to generate a first radiation beam having a first energy and a second radiation beam having a second energy different from the first energy, respectively, in a third alternating pattern corresponding to the first and second alternating patterns.

* * * * *